US006475057B1

(12) United States Patent
Norman

(10) Patent No.: US 6,475,057 B1
(45) Date of Patent: Nov. 5, 2002

(54) MULTI-FUNCTION MOBILE

(75) Inventor: Lisa C Norman, Solana Beach, CA (US)

(73) Assignee: Infantino, LLC, San Diego, CA (US)

( * ) Notice: Subject to any disclaimer, the term of this patent is extended or adjusted under 35 U.S.C. 154(b) by 0 days.

(21) Appl. No.: 09/970,062

(22) Filed: Oct. 3, 2001

(51) Int. Cl.[7] ..... A63H 33/00
(52) U.S. Cl. ..... 446/227; 446/901
(58) Field of Search ..... 446/227, 228, 446/229, 901, 107, 486, 369, 371; 434/247, 258, 392, 393, 433; 482/18, 20, 34, 38, 91; 602/18

(56) References Cited

U.S. PATENT DOCUMENTS 3,978,610 A * 9/1976 Stubbmann
4,043,325 A * 8/1977 Ochs et al. ..... 128/75
4,335,539 A * 6/1982 Jones
4,722,713 A * 2/1988 Williams et al. ..... 446/227
4,833,730 A * 5/1989 Nelson ..... 2/44
4,881,529 A * 11/1989 Santos ..... 128/75
5,046,980 A * 9/1991 Tai et al. ..... 446/73
5,334,133 A * 8/1994 Carroll ..... 602/18
5,352,145 A * 10/1994 Raiffe et al. ..... 446/227
5,904,662 A * 5/1999 Myoga ..... 602/18
6,016,926 A * 1/2000 Smith et al. ..... 211/119.011
6,058,517 A * 5/2000 Hartunian ..... 2/468

* cited by examiner

*Primary Examiner*—Derris H. Banks
*Assistant Examiner*—Jamila Williams
(74) *Attorney, Agent, or Firm*—Stetina Brunda Garred & Brucker

(57) ABSTRACT

A multi-function mobile comprising an elongate, flexible support bar defining opposed first and second end portions. Attached to the support bar is a connector mechanism which is moveable between latched and unlatched positions. The first and second end portions of the support bar are maintained in close proximity to each other when the connector mechanism is in its latched position. Releaseably engageable to the first and second end portions of the support bar is a pliable cover member which is used to maintain the support bar in a substantially ring-like configuration. An elongate engagement strap is releaseably engageable to the connector mechanism when the same is moved to its unlatched position. The engagement strap is sized and configured such that when engaged to the connector mechanism, the first and second end portions are drawn toward each other in a manner causing the support bar to assume a substantially arch-like configuration.

39 Claims, 3 Drawing Sheets

Fig. 1
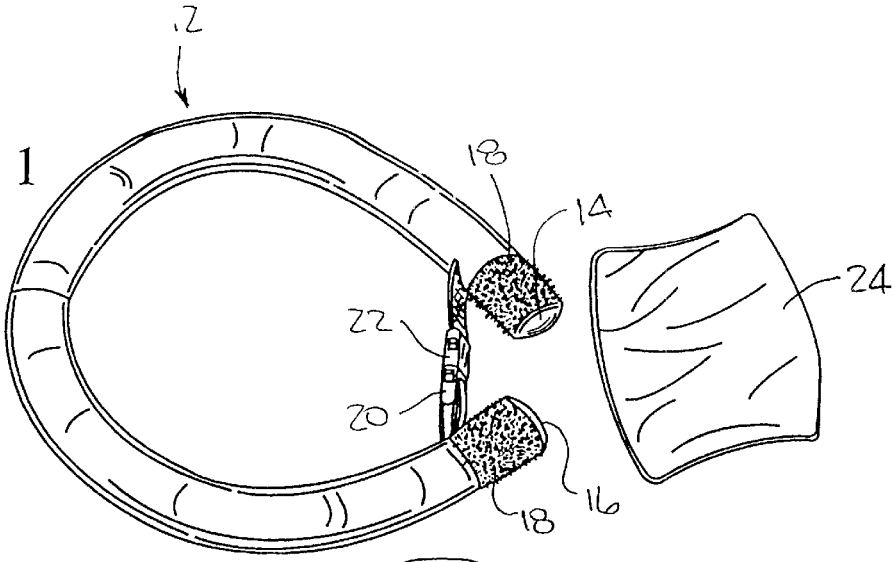
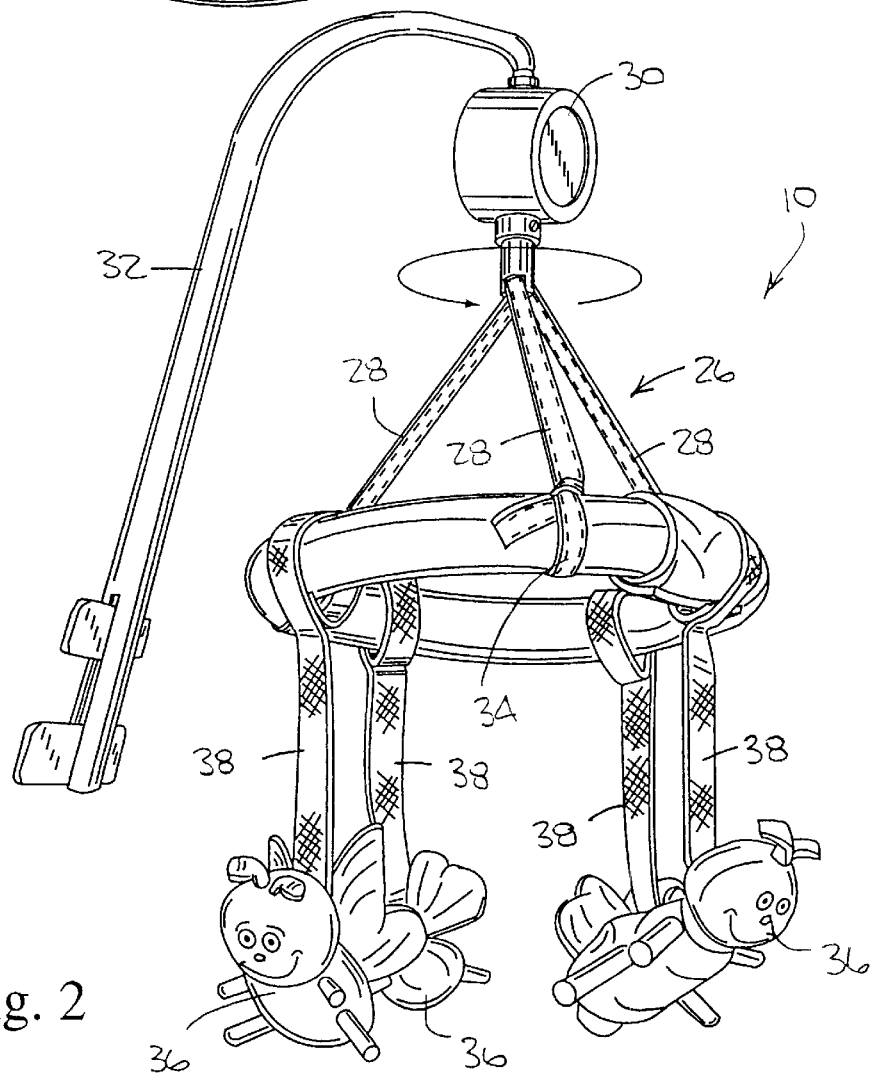
Fig. 2

MULTI-FUNCTION MOBILE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to toys for infants, and more particularly to a mobile that may be interfaced to an infant's bed or crib in a conventional manner, and may be quickly and easily converted or reconfigured into an activity arch which may be used in conjunction with a car seat or stroller.

As is well known to parents, commonly found in most nurseries are mobiles which are attachable to an infant's crib. These mobiles are removably attachable to a portion of the crib (e.g., a side rail), and are typically provided with a wind-up musical element or music box component that is operative to play a melody while simultaneously rotating a portion of the mobile. Traditionally, mobiles include elongate plastic arms which are suspended from the music box component, with each of the plastic arms including one or more plush toys or characters hanging therefrom. In most mobiles, the arms and plush characters are rotated relative to the music box component.

Another item known to most parents and popular with toddlers is referred to as an activity arch. Activity arches typically comprise detachable toys that are suspended from a bar which is attachable to and extensible over a portion of a car seat or stroller. In many currently known activity arches, the attachment to the car seat or stroller is accomplished through the use of an adjustable webbing strap which extends underneath the seat portion of the car seat or stroller.

It is generally accepted that mobiles should be removed from an infant's crib when the infant reaches an age of approximately four months, i.e., when the infant is physically capable of pushing up on his/her hands and knees. In this regard, the removal of the mobile from the crib is to reduce the risk of the infant being injured by the collapse of the mobile or a portion thereof as a result of pulling on the suspended plush toys or characters. At about the time the infant reaches an age wherein the mobile should be removed from the crib, the infant is also at an age particularly suited for play with an activity arch.

In the interests of economy, the present invention provides a uniquely configured mobile which may be interfaced to a crib in a traditional manner, and is specifically adapted to be reconfigured into an activity arch removably engageable to a car seat or stroller. Thus, the present invention provides the attributes of both a crib mobile and an activity arch within a single product, thus providing a product which is more economical as providing a longer time frame for use by the infant/toddler.

BRIEF SUMMARY OF THE INVENTION

In accordance with the present invention, there is provided a multi-function mobile which comprises an elongate, flexible support bar defining opposed first and second ends. The support bar is preferably fabricated from foam rubber or a polystyrene foam, and may optionally be provided with a fabric cover. Attached to the support bar is a connector mechanism which is moveable between latched and unlatched positions. The connector mechanism itself preferably comprises male and female connectors which are attached to the support bar adjacent respective ones of the first and second end portions thereof. When the connector mechanism is in its unlatched position (i.e., the male and female connectors are detached from each other), the support bar may be extended into a substantially straight or linear orientation. Conversely, the movement of the connector mechanism to its latched position (i.e., the attachment of the male and female connectors to each other) operatively maintains the first and second end portions of the support bar in close proximity to each other.

The multi-function mobile further comprises a pliable or flexible cover member which is releaseably engageable to the first and second end portions of the support bar in a manner maintaining the support bar in a substantially annular or ring-like configuration. The first and second end portions of the support bar each preferably include a layer of hook and loop fastener material applied thereto, with the cover member itself preferably being fabricated from hook and loop fastener material. The mobile further comprises a support strap which is advanceable along the support bar and suspendable from a support structure, such as a music box component of the mobile. The mobile also includes a plurality of plush toys, each of which is releaseably attachable to the support bar via an elongate strap.

The present mobile further comprises an elongate engagement strap having opposed ends which are releaseably engageable to respective ones of the male and female connectors of the connector mechanism when the connector mechanism is moved to its unlatched position. The engagement strap is sized and configured such that when engaged to and extended between the male and female connectors, the first and second end portions of the support bar are drawn toward each other in a manner causing the support bar to assume a substantially arch-like configuration. Thereafter, the engagement strap may be placed underneath the seat portion of a car seat or stroller such that the support bar extends over a portion thereof, and the plush toys suspended from the support bar via the straps are within easy reach of an infant seated within the car seat or stroller.

BRIEF DESCRIPTION OF THE DRAWINGS

These, as well as other features of the present invention, will become more apparent upon reference to the drawings wherein:

FIG. 1 is a top view of the support bar and joint cover components of the multi-function mobile constructed in accordance with the present invention;

FIG. 2 is a perspective view of the present multi-function mobile as configured for use as a traditional mobile;

DETAILED DESCRIPTION OF THE INVENTION

Figure 3:
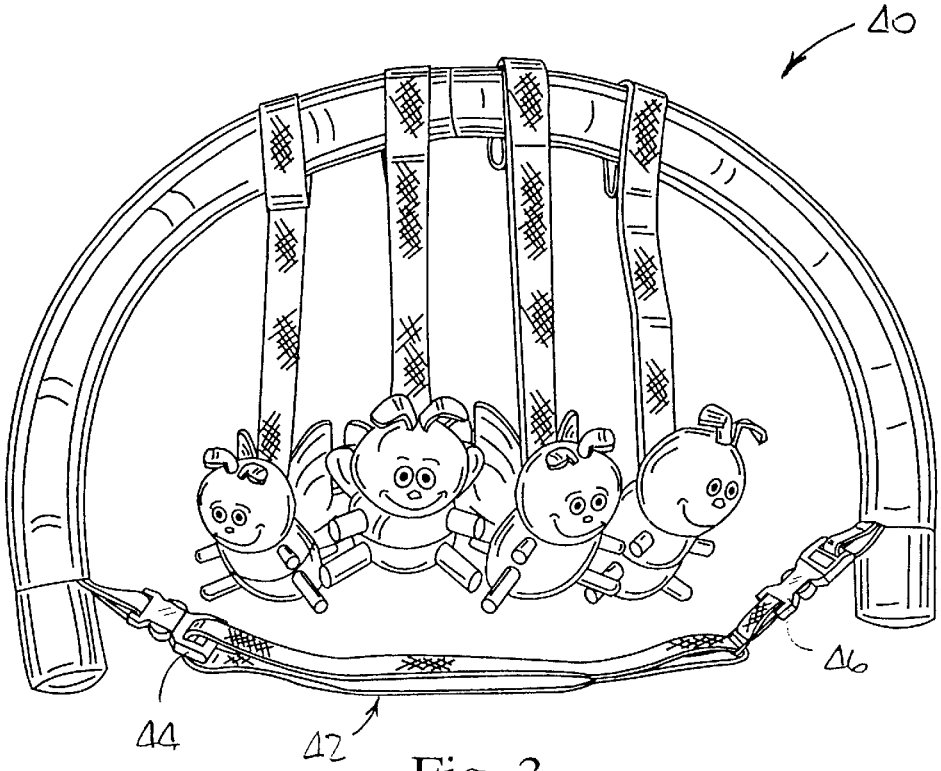
FIG. 3 is a perspective view of the present multi-function mobile reconfigured for use as an activity bar engageable to a car seat or stroller.

Referring now to the drawings wherein the showings are for purposes of illustrating preferred embodiments of the present invention only, and not for purposes of limiting the same, FIG. 2 perspectively illustrates the multi-function mobile 10 constructed in accordance with the present invention. As seen in FIGS. 1 and 2, the mobile 10 comprises an elongate support bar 12 which is preferably cylindrically configured, i.e., has a generally circular cross-sectional configuration. The support bar 12 defines opposed first and second ends 14, 16 and is preferably fabricated from a soft, flexible material such as foam rubber or a polystyrene foam. The support bar 12 may optionally be provided with a fabric cover.

As seen in FIG. 1, the support bar 12 includes a pair of attachment regions 18 disposed adjacent respective ones of the opposed first and second ends 14, 16 thereof. Each of the attachment regions 18 is preferably fabricated from a layer of hook and loop fastener material (e.g., Velcro) which extends about the complete circumference of the support bar 12. Additionally, attached to the support bar adjacent respective ones of the attachment regions 18 is a male connector 20 and a female connector 22 which are releaseably engageable to each other. When the male and female connectors 20, 22 are engaged to each other in the manner shown in FIG. 1, the support bar 12 is caused to assume an arcuate configuration wherein the first and second ends 14, 16, though being disposed in close proximity to each other, are not in direct contact. As will be recognized, the detachment or disengagement of the male and female connectors 20, 22 from each other allows the support bar 12 to be extended into a substantially straight configuration.

When the support bar 12 is to be configured for use as the mobile 10 shown in FIG. 2, a cover member or joint cover 24 is employed for use in causing the support bar 12 to assume a more annular, ring-like configuration than that which is achieved solely by the engagement of the male and female connectors 20, 22 to each other. The joint cover 24 is itself preferably fabricated from a hook and loop fastener material which is releaseably engageable to both the attachment regions 18.In this regard, upon the first and second ends 14, 16 being brought into direct contact with each other, the wrapping of the joint cover 24 about and over the attachment regions 18 of the support bar 12 assists in maintaining the support bar 12 in a generally circular configuration, while effectively hiding or masking the joint defined between the first and second ends 14,16. It is contemplated that the joint cover 24 will also be wrapped about the engaged male and female connectors 20, 22 to further hide the same.

In addition to the support bar 12 and joint cover 24, the mobile 10 comprises a support strap 26 comprising three strap segments 28, the upper ends of which are attached to each other. The attached upper ends of the strap segments 28 are themselves attachable to a music box component 30 of the mobile 10.The music box component 30 is suspended from the distal end of an elongate support arm 32 which is itself attachable to a support structure such as an infant's crib. The lower ends of the strap segments 28 each preferably define a loop or opening 34 which is sized and configured to accommodate the support bar 12. In this regard, when the support bar 12 is to be configured for use as the mobile 10, the support bar 12 is advanced through each of the three loops 34 in series prior to the male and female connectors 20, 22 being releaseably engaged to each other and the joint cover 24 being wrapped about the attachment regions 18 in the above-described manner. As seen in FIG. 2, the loops 34 are preferably positioned so as to be spaced from each other at equidistant intervals of approximately 120°.

The mobile 10 of the present invention further comprises a plurality of plush toys or characters 36, each of which is attached to the lower end of a corresponding, elongate strap 38.The upper portion of each strap 38 is extensible about the support bar 12 and releaseably attachable to itself through the use of, for example, corresponding strips of hook and loop fastener material. The point of attachment of the upper end of each strap 38 to itself can be used to vary the length of each strap 38, and more particularly the distance by which the corresponding plush toy 36 is separated from the support bar 12. As shown in FIG. 2, four plush toys 36 are included with the mobile 10, with the corresponding straps 38 being releaseably engaged to the support bar 12 so as to be separated by intervals of approximately 90°. Those of ordinary skill in the art will recognize that the plush toys 36 may be provided in numbers, shapes and/or sizes differing from those shown in FIG. 2, and that other types of decorative items may be suspended from the support bar 12 other than for the plush toys 36.

As indicated above, the mobile 10 of the present invention may be selectively reconfigured into an activity arch 40 which is shown in FIG. 3. To facilitate such reconfiguration, the support strap 26 is initially disengaged or detached from the music box component 30 of the mobile 10.Thereafter, the joint cover 24 is unwrapped from the attachment regions 18, thus exposing the interconnected male and female connectors 20, 22. Prior to the detachment of the support strap 26 from the music box component 30, the straps 38 supporting the plush toys 36 will typically be detached from the support bar 12. Upon the detachment of the male and female connectors 20, 22 from each other, the support strap 26 is removed from the support bar 12.

Figure 4:
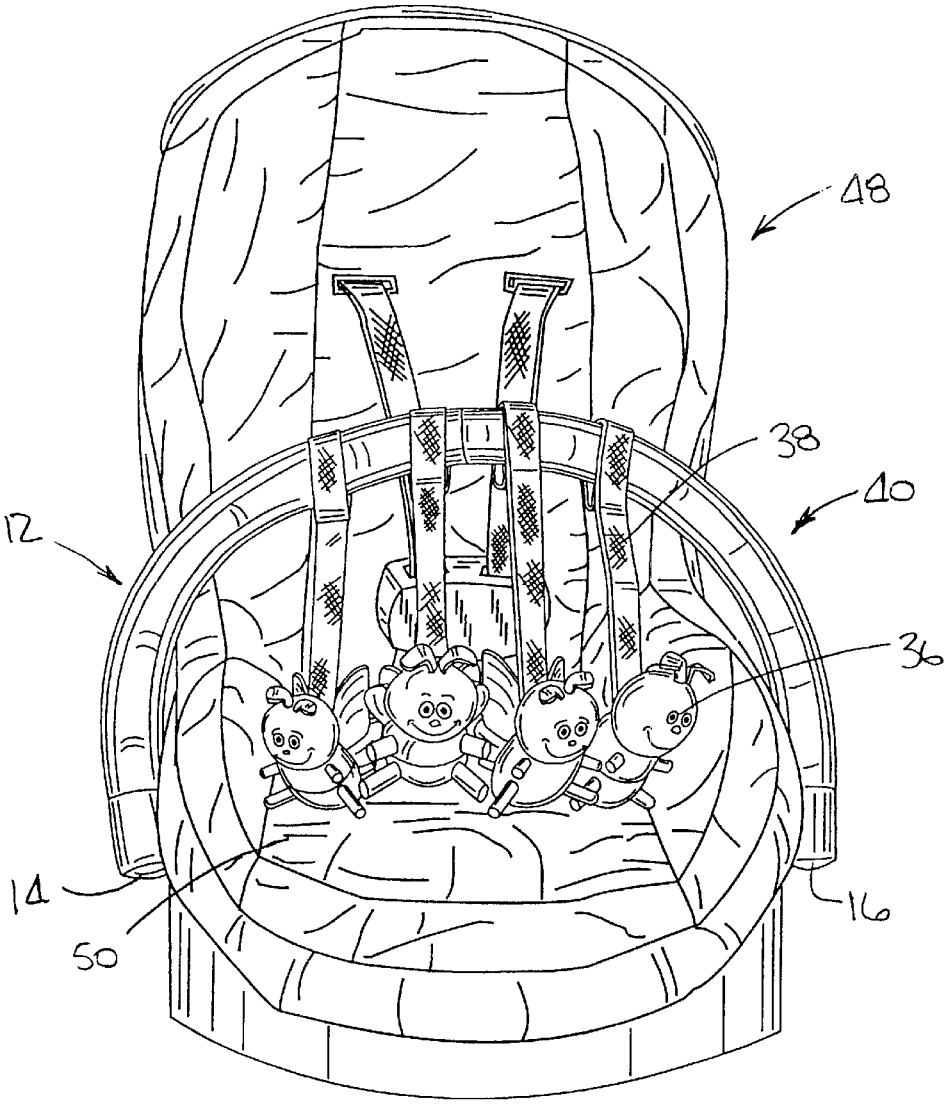
FIG. 4 is a perspective view of a car seat including the activity bar shown in FIG. 3 interfaced thereto.

The activity arch 40 includes an elongate engagement strap 42 which includes a male strap connector 44 on one end thereof, and a female strap connector 46 on the opposite end thereof. The male strap connector 44 is releaseably engageable to the female connector 22 of the support bar 12, with the female strap connector 46 being releaseably engageable to the male connector 20 of the support bar 12. As seen in FIG. 3, the engagement strap 42 is preferably sized and configured such that when attached to the support bar 12 through the use of the corresponding connectors as described above, the first and second ends 14, 16 of the support bar 12 are pulled toward each other in a manner causing the support bar 12 to assume an arcuate, arch-like configuration. When the support bar 12 assumes this configuration, the same may be interfaced to a car seat 48 in the manner shown in FIG. 4, with such interface being accomplished by the placement or location of the engagement strap 42 beneath the lower seat portion 50 of the car seat 48. Either prior or subsequent to the interface of the support bar 12 to the car seat 48 through the use of the engagement strap 44,the straps 38 and hence the plush toys 36 may be attached to the support bar 12 in the same manner previously described in relation to the attachment of the straps 38 to the support bar 12 as configured for use as the mobile 10. As is apparent from FIG. 4, the attachment of the straps 38 to the support bar 12 in the activity arch 40 suspends the plush toys 36 in a location which is well suited for play by the infant or toddler. Though not shown, the activity arch 40 may also be used in conjunction with a stroller. In the activity arch 40, neither the joint cover 24 nor support strap 26 included in the mobile 10 are utilized.

Figure 5:
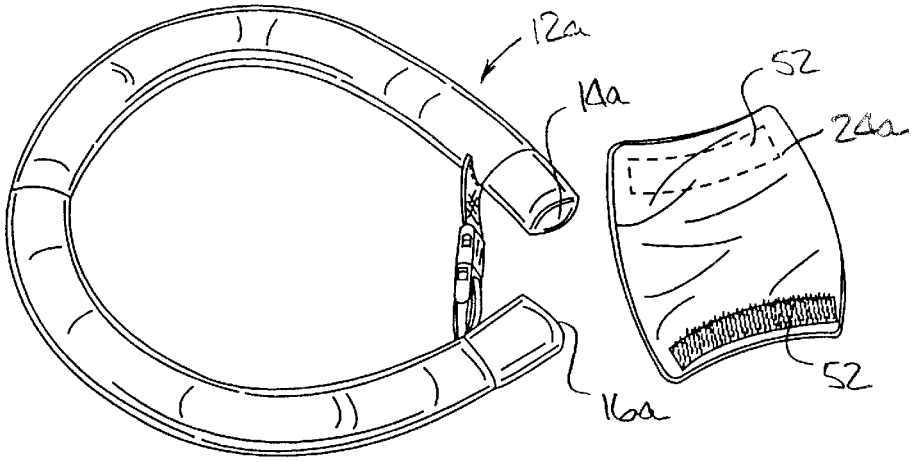
FIG. 5 is a top view of an alternative embodiment of the support bar and joint cover shown in FIG. 1.

Referring now to FIG. 5, there is depicted a support bar 12 a and a joint cover 24 a constructed in accordance with an alternative embodiment of the present invention. The support bar 12 a is identical to the support bar 12 described above, except that the attachment regions 18 of the hook and loop fastener material are not included adjacent respective ones of the opposed first and second ends 14*a,* 16*a* of the support bar 12*a*. Additionally, the joint cover 24*a* is not fabricated in its entirety from hook and loop fastener material, but rather includes only two elongate strips 52 of hook and loop fastener material disposed on opposed faces or surfaces of the joint cover 24*a* and extending along respective ones of an opposed pair of edge segments thereof. The joint cover 24*a* is wrapped about the support bar 12*a* in the same manner discussed above in relation to the support bar 12 and joint cover 24, except that the wrapping of the joint cover 24*a* is accomplished such that the strips 52 are releaseably engaged to each other.

Additional modifications and improvements of the present invention may also be apparent to those of ordinary skill in the art. Thus, the particular combination of parts described and illustrated herein is intended to represent only certain embodiments of the present invention, and are not intended to serve as limitations of alternative devices within the spirit and scope of the invention.

What is claimed is:

1. A multi-function mobile, comprising:

an elongate, flexible support bar defining opposed first and second end portions;

a connector mechanism including a female connector attached to the support bar adjacent the first end portion thereof and a male connector attached to the support bar adjacent the second end portion thereof, the male and female connectors being movable between latched and unlatched positions, with the first and second end portions of the support bar being maintained in close proximity to each other when the male and female connectors are in the latched position; and a pliable cover member releasably engageable to the first and second end portions of the support bar in a manner maintaining the support bar in an annular configuration.

2. The mobile of claim 1 further comprising:

an elongate engagement strap extensible between the male and female connectors, the engagement strap having opposed ends, with one of the ends being releasably engageable to the male connector and one of the ends being releasably engageable to the female connector;

the engagement strap being sized and configured to draw the first and second end portions toward each other when engaged to the male and female connectors in a manner causing the support bar to assume an arcuate configuration.

3. The mobile of claim 1 wherein:

the first and second end portions of the support bar each include a layer of hook-and-loop fastener material applied thereto; and the cover member is fabricated from hook-and-loop fastener material.

4. The mobile of claim 1 further comprising a support strap advanceable along the support bar and suspendable from a support structure.

5. The mobile of claim 1 further comprising a plurality of plush toys releasably attachable the support bar.

6. The mobile of claim 5 herein each of the plush toys is releasably attachable to the support bar via an elongate strap.

7. The mobile of claim 1 wherein the support bar is fabricated from foam rubber.

8. A multi-function mobile, comprising:

an elongate, flexible support bar defining opposed first and second end portions;

a connector mechanism attached to the support bar and movable between latched and unlatched positions, the first and second end portions of the support bar being maintained in close proximity to each other when the connector mechanism is in the latched position;

a pliable cover member releasably engageable to the first and second end portions of the support bar in a manner maintaining the support bar in an annular configuration; and a support strap advanceable along the support bar and suspendable from a support structure.

9. The mobile of claim 8 wherein:

the first and second end portions of the support bar each include a layer of hook-and-loop fastener material applied thereto; and the cover member is fabricated from hook-and-loop fastener material.

10. The mobile of claim 8 Further comprising a plurality of plush toys releasably attachable to the support bar.

11. The mobile of claim 10 wherein each of the plush toys is releasably attachable to the support bar via an elongate strap.

12. The mobile of claim 8 wherein the connector mechanism comprises a female connector attached to the support bar adjacent the first end portion thereof and a male connector attached to the support bar adjacent the second end portion thereof.

13. The mobile of claim 12 further comprising:

an elongate engagement strap extensible between the male and female connectors, the engagement strap having opposed ends, with one of the ends being releasably engageable to the male connector and one of the ends being releasably engageable to the female connector;

the engagement strap being sized and configured to draw the first and second end portions toward each other when engaged to the male and female connectors in a manner causing the support bar to assume an arcuate configuration.

14. The mobile of claim 8 wherein the support bar is fabricated from foam rubber.

15. The mobile of claim 8 Further comprising:

an elongate engagement strap releasably engageable to the connector mechanism when the connector mechanism is in the unlatched position;

the engagement strap being sized and configured to draw the first and second end portions toward each other when engaged to the connector mechanism in a manner causing the support bar to assume an arcuate configuration.

16. A multifunction mobile, comprising:

an elongate, flexible support bar defining opposed first and second end portions;

a connector mechanism attached to the support bar and movable between latched and unlatched positions, the first and second end portions of the support bar being maintained in close proximity to each other when the connector mechanism is in the latched position;

a pliable cover member releaseably engageable to the first and second end portions of the support bar in a manner maintaining the support bar in an annular configuration; and a plurality of plush toys releasably attachable to the support bar.

17. The mobile of claim 16 wherein each of the plush toys is releasably attachable to the support bar via an elongate strap.

18. The mobile of claim 16 Wherein:

the first and second end portions of the support bar each include a layer of hook-and-loop fastener material applied thereto; and the cover member is fabricated from hook-and-loop fastener material.

19. The mobile of claim 16 further comprising a support strap advanceable along the support bar and suspendable from a support structure.

20. The mobile of claim 16 Wherein the connector mechanism comprises a female connector attached to the support bar adjacent the first end portion thereof and a male connector attached to the support bar adjacent the second end portion thereof.

21. The mobile of claim 20 further comprising:

an elongate engagement strap extensible between the male and female connectors, the engagement strap having opposed ends, with one of the ends being releasably engageable to the male connector and one of the ends being releasably engageable to the female connector:

the engagement strap being sized and configured to draw the first and second end portions toward each other when engaged to the male and female connectors in a manner causing the support bar to assume an arcuate configuration.

22. The mobile of claim 16 wherein the support bar is fabricated from foam rubber.

23. The mobile of claim 16 further comprising:

an elongate engagement strap releasably engageable to the connector mechanism when the connector mechanism is in the unlatched position;

the engagement strap being sized and configured to draw the first and second end portions toward each other when engaged to the connector mechanism in a manner causing the support bar to assume an arcuate configuration.

24. A multi-function mobile, comprising:

an elongate, flexible support bar defining opposed first and second end portions;

a connector mechanism attached to the support bar and moveable between latched and unlatched positions, the first and second end portions of the support bar being maintained in close proximity to each other when the connector mechanism is in the latched position;

a pliable cover member releasably engageable to the first and second end portions of the support bar in a manner maintaining the support bar in an annular configuration; and an elongate engagement strap releasably engageable to the connector mechanism when the connector mechanism is in the unlatched position, the engagement strap being sized and configured to draw the first and second end portions toward each other when engaged to the connector mechanism in a manner causing the support bar to assume an arcuate configuration.

25. The mobile of claim 24 herein:

the first and second end portions of the support bar each include a layer of hook-and-loop fastener material applied thereto; and the cover member is fabricated from hook-and-loop fastener material.

26. The mobile of claim 24 further comprising a support strap advanceable along the support bar and suspendable from a support structure.

27. The mobile of claim 24 further comprising a plurality of plush toys releasably attachable to the support bar.

28. The mobile of claim 27 wherein each of the plush toys is releasably attachable to the support bar via an elongate strap.

29. The mobile of claim 24 wherein the connector mechanism comprises:

a female connector attached to the support bar adjacent the first end portion thereof; and a male connector attached to the support bar adjacent the second end portion thereof;

the engagement strap having opposed ends, with one of the ends being releasably engageable to the male connector and one of the ends being releasably engageable to the female connector.

30. The mobile of claim 24 wherein the support bar is fabricated from foam rubber.

31. A multi-function mobile, comprising:

an elongate, flexible support bar defining opposed first and second ends;

a connector mechanism attached to the support bar and movable between latched and unlatched positions, the first and second ends of the support bar being maintained in close proximity to each other such that a joint is defined therebetween when the connector mechanism is in the latched position; and a pliable cover member releaseably engageable to and wrappable about the support bar in a manner maintaining the support bar in an annular configuration and concealing the joint defined between the first and second ends thereof.

32. The mobile of claim 31 wherein:

the first and second end portions of the support bar each include a layer of hook and loop fastener material applied thereto; and the cover member is fabricated from hook and loop fastener material.

33. The mobile of claim 31 further comprising a support strap advanceable along the support bar and suspendable from a support structure.

34. The mobile of claim 31 further comprising a plurality of plush toys releaseably attachable to the support bar.

35. The mobile of claim 34 wherein each of the plush toys is releaseably attachable to the support bar via an elongate strap.

36. The mobile of claim 31 wherein the connector mechanism comprises a female connector attached to the support bar adjacent the first end thereof and a male connector attached to the support bar adjacent the second end thereof.

37. The mobile of claim 36 further comprising:

an elongate engagement strap extensible between the male and female connectors, the engagement strap having opposed ends, with one of the ends being releasably engageable to the male connector and one of the ends being releasably engageable to the female connector;

the engagement strap being sized and configured to draw the first and second ends toward each other when engaged to the male and female connectors in a manner causing the support bar to assume an arcuate configuration.

38. The mobile of claim 31 wherein the support bar is fabricated from foam rubber.

39. The mobile of claim 31 further comprising:

an elongate engagement strap releaseably engageable to the connector mechanism when the connector mechanism is in the unlatched position;

the engagement strap being sized and configured to draw the first and second ends toward each other when engaged to the connector mechanism in a manner causing the support bar to assume an arcuate configuration.

* * * * *